United States Patent [19]

Moye

[11] Patent Number: 4,913,420

[45] Date of Patent: Apr. 3, 1990

[54] STARTING BLOCK FOR RUNNERS

[75] Inventor: Charles W. Moye, Akron, Ohio

[73] Assignee: All Ohio Youth Athletic Club, Akron, Ohio

[21] Appl. No.: 201,055

[22] Filed: Jun. 1, 1988

Related U.S. Application Data

[63] Continuation-in-part of Ser. No. 856,589, Apr. 25, 1986, Pat. No. 4,754,965.

[51] Int. Cl.[4] ..... A63K 3/02

[52] U.S. Cl. ..... 272/105

[58] Field of Search ..... 272/105, 145, 100, 65; 128/25 B

[56] References Cited

U.S. PATENT DOCUMENTS

| | | | |
|---|---|---|---|
| 3,724,843 | 4/1973 | Fichter et al. | 272/105 |
| 3,799,542 | 3/1974 | Potgieter | 272/105 |
| 4,669,450 | 6/1987 | Lindberg | 128/25 B |
| 4,754,965 | 7/1988 | Moye | 272/105 |

FOREIGN PATENT DOCUMENTS

| | | | |
|---|---|---|---|
| 94902 | 3/1939 | Sweden | 272/105 |

*Primary Examiner*—Richard J. Apley
*Assistant Examiner*—H. Flaxman
*Attorney, Agent, or Firm*—Renner, Kenner, Greive, Bobak, Taylor & Weber

[57] ABSTRACT

A starting block (10, 110, 210) for a runner to be used on a track having running lanes extending from a starting line (L, L', L'') to a finish line including, a frame (11, 111, 211) for positioning in alignment with a running lane proximate to the starting line, fasteners (22, 222) for maintaining the frame at a selected location on the track, a first pad (55, 155, 255) selectively attachable longitudinally of the frame and having a substantially horizontal surface (56, 157, 257) for supporting one foot of a runner in a standing position, and a second pad (30, 130, 230) selectively attachable longitudinally of the frame and having an angularly upwardly extending surface (31, 131, 231) for engagement by the other foot of a runner in a standing position to assist in thrusting the runner across the starting line in a running lane toward the finish line.

20 Claims, 4 Drawing Sheets

STARTING BLOCK FOR RUNNERS

This is a continuation-in-part of my copending application Ser. No. 06/856 now U.S. Pat. No. 4754965 filed Apr. 25, 1986, entitled "Starting Block for Runners".

Technical Field

The present invention relates generally to starting blocks used to achieve fast acceleration in certain running events of track and field competition. More particularly, the present invention relates to a starting block which is designed to optimize a runner's acceleration from the starting line from a standing position. More specifically, the invention relates to a starting block which is adapted to receive a runner's feet in a standing start position and provides suitably angled and tractioned surfaces to optimize a runner's acceleration from such an erect, standing position.

Background Art

Starting blocks of various types have long been employed in competitive track and field activities. The use of starting blocks is of primary significance in relatively short distance sprinting and hurdling events where the elapsed time of a race is a matter of seconds and where differences in the performance of different runners is frequently measured in small fractions of a second.

The general configuration and the method of employing starting blocks has remained essentially the same for many decades. The accepted theory for optimum acceleration at the start of a race has proceeded on the premise that a runner should be in a crouched position with both hands positioned on the ground at approximately shoulder width in close proximity to the starting line of a racing lane with one leg beneath the body and with that foot being in substantially closer proximity to the starting line than the other leg and foot which are extended rearwardly at the commencement of the running event. The forward foot has the leg severely bent at the knee and substantially under the runner in the preparatory position. The leg displaced from the starting line has the knee positioned on the ground in the preparatory position to afford stability and a degree of comfort in the crouched preparatory position. In the subsequent set position, which takes place instantaneously prior to commencement of the race, the runner shifts his body weight forwardly to transfer greater weight to the hands, to raise the knee of the rearward foot off the ground and to prepare to push outwardly across the starting line in the crouched position from starting block pads or pedals which are positioned rearwardly of the runner's feet in the preparatory and set positions.

The runner is trained to slowly right his body from the crouched position with the back nearly horizontal or parallel to the ground to the upright running position gradually over a number of strides. This theoretically minimizes the effort necessary to overcome gravity in righting the body while minimizing the possibilities of losing balance or interfering with the runner's stride during the transition between the crouched starting and upright running positions.

For employing the crouched position start conventional starting blocks or other upright members which are attached to the track such as to resist rearward displacement when a runner applies pressure thereto in an effort to accelerate across the starting line. While such blocks may originally have consisted of mere mounds of dirt or individual block elements attached to the track as by a spike, for a number of years starting blocks have consisted of an integrated unit having a central longitudinal frame to which two pedals or pads are attached. Normally the pedals are essentially identical except that one is adapted to engage one side of the central frame while the other is adapted for attachment to the other side of the central frame. Normally the pedals can be positioned at any desired location longitudinally of the frame in order that a pedal may support either foot as the advanced foot in the crouched starting position with the other pedal being appropriately rearwardly positioned for support of the other foot of the runner.

Beyond these common features running block improvements have been only in the nature of refinements, generally of a very minor nature. For example, the upright foot engaging surfaces have been positioned at different angles to the horizontal. In some instances, the pedals have been provided with structure permitting independent variable angular positioning of the foot engaging surfaces. In other instances pedals of different widths have been provided to require or to accommodate different width stances in the crouched starting position. In other instances, longer upstanding foot engaging surfaces of the pedals have been employed to engage or contact more than the ball of the runner's foot, as for preventing the rolling back of a runner's heel as a reaction to the start of a race.

Although the acceptance of the crouched starting theory and the starting blocks created therefor have been nearly unanimous in competitive circles for many years, there are recent indications of departures from this theory. Applicant and perhaps others are of the belief that a runner may be capable of accelerating to optimum speed and positioning in a shorter time and with less energy expenditure from a standing start position. While conventional starting blocks may be employed to afford some assistance in effecting a standing start, these standard blocks may not afford the optimum basis for acceleration from a standing start position.

Disclosure of the Invention

Therefore, an object of the present invention is to provide a starting block which makes it possible to execute a starting movement for races from a standing position to eliminate the significant and compound stresses upon a runner's leg muscles during the transition from a crouched to an upright running position. Another object of the present invention is to provide starting blocks for a standing start which virtually immediately positions a runner in an optimum running position. A further object of the invention is to provide a starting block for a standing start wherein the runner's rear foot may be thrust into engagement with the rear block so that the opposite reaction propels or accelerates the runner outwardly from the starting line in a running position.

Yet another object of the invention is to provide a starting block for a standing start which eliminates the necessity for overcoming gravity in raising the body as is required in a conventional crouched start. A still further object of the invention is to provide a starting block wherein injuries may be reduced during races and practices due to the elimination of the severely bent leg position which is necessitated in the crouched start. Still another object of the invention is to provide a starting block wherein additional practice starts may be under-taken due to the fact that the leg muscle fatigue necessarily associated with the crouched start is obviated such that runners may become more proficient in perfecting the starting movement.

Yet another object of the invention is to provide a starting block for a standing start which may be positioned such that foot pads are substantially closer to the starting line than is possible when employing a crouched start such that the runner commences the race with a distance advantage of a step or a substantial portion thereof. Another object of the invention is to provide a starting block wherein the runner may be initially positioned in essentially a running position of the arms, legs and torso to provide comfort, as well as a minimum of transition to full speed running. Yet another object of the invention is to provide a device which optimizes traction during a standing start while providing extreme comfort and flexibility in the preparatory or ready and the set positions prior to starting.

A still further object of the invention is to provide a starting block which can be readily adjusted and otherwise adapted for runners having different stances and preferences in regard to the standing start position. A still further object of the invention is to provide a starting block which is relatively noncomplex, durable and can be safely and effectively employed by runners having diverse skill levels or runners with minor physical injuries or limitations.

An alternate or second embodiment of the invention has the aforesaid characteristics and additionally provides the following further features.

An object of the second embodiment of the invention is to provide a starting block wherein one of the foot pads is mounted on the main frame. Another object of this embodiment is to provide such a starting block wherein the other foot pad is selectively longitudinally displaced from the one foot pad along the main frame and laterally offset from the main frame. A further object of this embodiment is to provide such a starting block wherein the other foot pad may be offset relative to the main frame to either side thereof to accommodate runners desiring to start with either foot in the advanced position and the other foot in a trailing position.

A further object of the second embodiment of the invention is to provide a starting block wherein one of the foot pads may advantageously be contoured for substantially mating engagement with the foot of a runner. Another object of this embodiment of the invention is to provide such a starting block wherein the frame and one foot pad may be an integral unit and the other foot pad a separate selectively attachable unit, whereby the starting block may be quickly and easily assembled and adjusted to meet the preferences of different runners. Yet another object of this embodiment is to provide such a starting block which has a minimum of parts, which can be quickly and easily assembled and adjusted without tools or mechanically actuated fasteners, and which is relatively noncomplex and inexpensive to fabricate.

Another alternate or third embodiment of the invention has the aforesaid characteristics and additionally provides the following further features.

An object of the third embodiment of the invention is to provide a starting block wherein one of the foot pads is mounted on the main frame. Another object of this embodiment is to provide such a starting block wherein the other foot pad is selectively longitudinally displaced from the one foot pad along the main frame and laterally offset to the side from the main frame. A further object of this embodiment is to provide such a starting block wherein the other foot pad may be offset relative to the main frame to both sides thereof to accommodate runners desiring to start with either foot in the advanced position and the other foot in a trailing position without repositioning the blocks.

A further object of the third embodiment of the invention is to provide a starting block wherein one of the foot pads is permanently attached at the front of and in alignment with the main frame for engagement with the foot of a runner. Another object of this embodiment of the invention is to provide such a starting block wherein the frame and one foot pad may be an integral unit and the other foot pad a separate selectively attachable unit, whereby the starting block may be quickly and easily assembled and adjusted to meet the preferences of different runners. Yet another object of this embodiment is to provide such a starting block which has a minimum of parts, which can be quickly and easily assembled without tools and which is relatively noncomplex and inexpensive to fabricate.

In general, a starting block for a runner to be used on a track having running lanes extending from a starting line to a finish line includes, a frame for positioning in alignment with a running lane proximate to the starting line, a fastener for maintaining the frame at a selected location on the track, a first pad attached longitudinally of said frame and having a substantially horizontal surface for supporting one foot of a runner in a standing position, and a second pad selectively attachable longitudinally of the frame and having an angularly upwardly extending surface for engagement by the other foot of a runner in a standing position to assist in thrusting the runner across the starting line in a running lane toward the finish line. One embodiment of the starting block of the invention has both the first pad and the second pad laterally offset relative to the frame; the second embodiment has one of the pads mounted on the frame and the other of the pads laterally offset in one direction relative to the frame; and the third embodiment has one of the pads mounted on the frame and the other of the pads laterally offset in both directions relative to the frame.

Preferred Embodiment For Carrying Out The Invention

Figure 1:
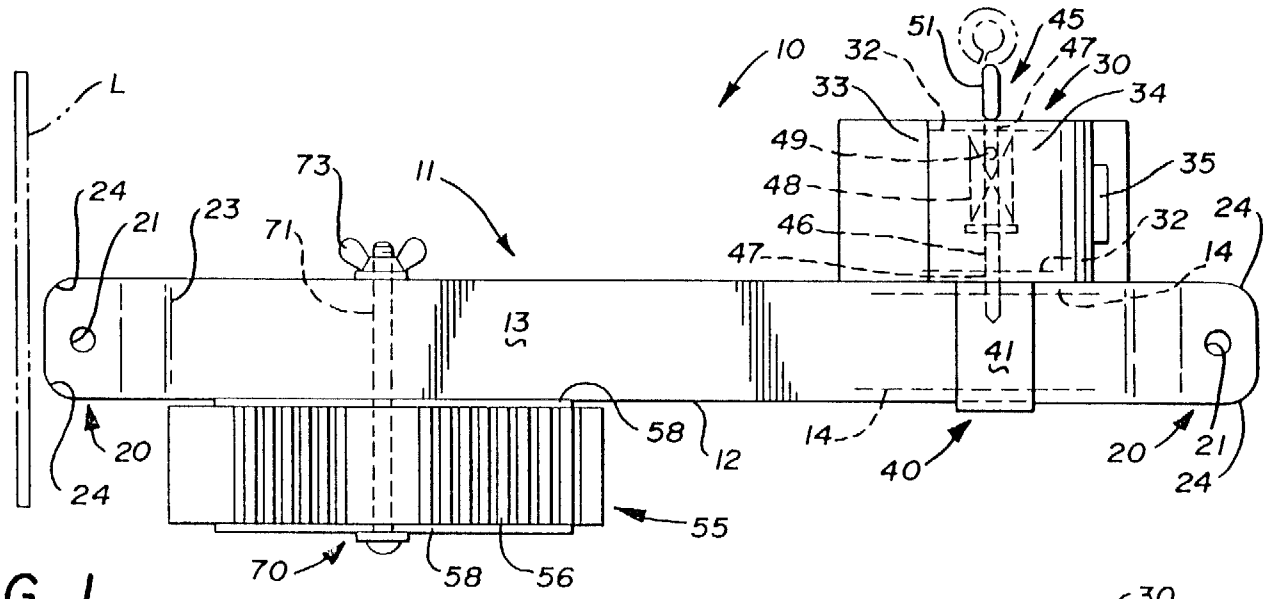
FIG. 1 is a top plan view of an exemplary starting block embodying concepts of the present invention positioned for utilization by a runner in a standing position proximate to the starting line of a running lane.
Figure 2:
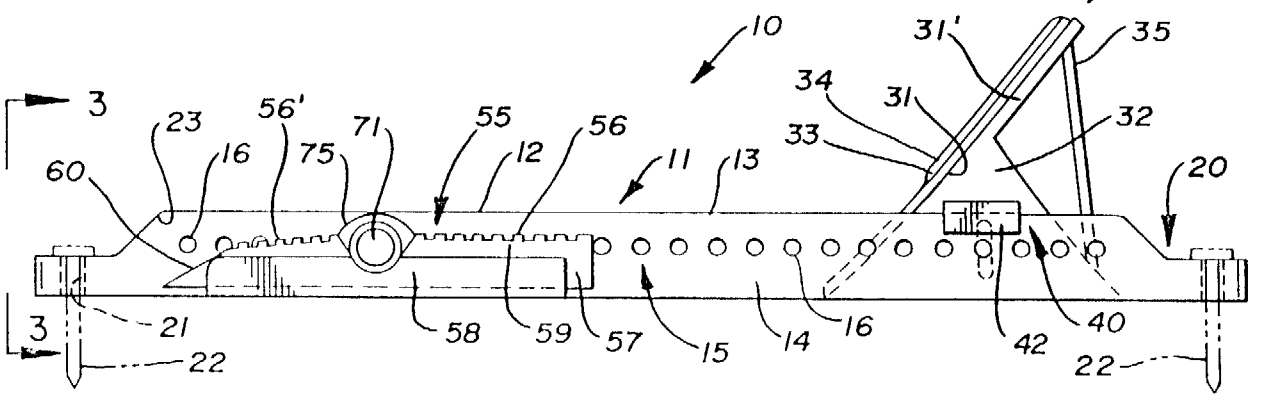
FIG. 2 is a side elevational view of the starting block of FIG. 1 depicting details of the foot supporting pads and the attachment of the foot pads to the central frame of the starting block.
Figure 3:
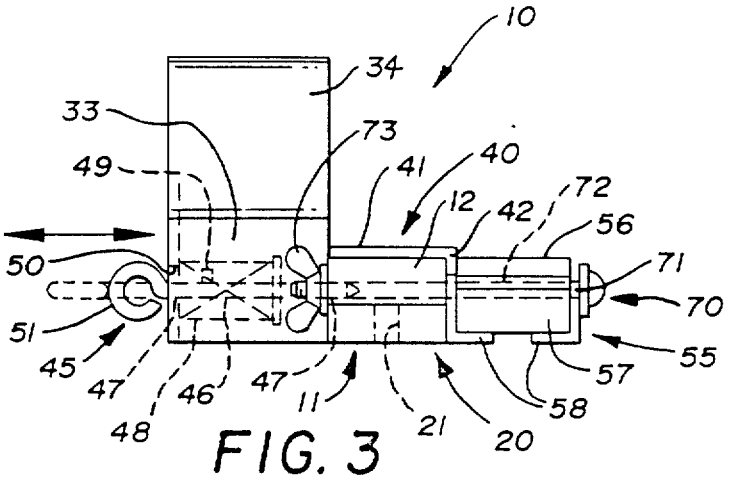
FIG. 3 is an end elevational view taken substantially along the line 3—3 of FIG. 1 and showing additional details of the foot pads and the attachment of the foot pads to the central frame of the starting block.

A starting block for a runner according to the concepts of the present invention is generally indicated by the numeral 10 in FIGS. 1–3 of the drawings. As shown for exemplary purposes, the starting block 10 may be positioned in close proximity to a starting line L of a group of racing lanes. In this respect, it is to be appreciated that a conventional block for use by a runner employing the conventional crouched position would need to be positioned a substantial distance to the right as viewed in FIG. 1 in order to accommodate the horizontal extension of the trunk and rearwardly projecting leg of a runner to effect the necessary positioning of the runner's hands behind the starting line L.

As shown, the starting block 10 has as the main longitudinal member aligned with the running lane and preferably positioned substantially perpendicular to the starting line L, a main frame or bar assembly, generally indicated by the numeral 11. Although the frame 11 may take various forms, as exemplified by prior art devices, the frame shown has a medial portion 12 of generally rectangular configuration. As shown, the medial portion 12 may be a generally U-shaped member having a uniform planar upper surface 13 with a projecting flange 14 extending from either lateral extremity thereof (see FIG. 2). The medial portion 12 is provided with structure for attachment of foot supporting elements, as described hereinafter, as by receivers, generally indicated by the numeral 15, which are positioned on the flanges 14 but could be otherwise positioned laterally of the upper surface 13 or otherwise on the flanges 14 in manners well known to persons skilled in the art. As shown, the receivers 15 constitute a plurality of bores 16 extending substantially the length of the medial portion 12 of frame 11 for a purpose to be hereinafter described.

The extremities of the medial portion 12 of frame 11 terminate in attachment elements, generally indicated by the numeral 20. As shown, each of the attachment elements 20 consists of a reduced thickness generally rectangular area which has a bore 21 for receiving fasteners such as the spikes 22 depicted in FIG. 2 which extend a substantial distance below frame 11 for purposes of insertion into the ground or a track surface to maintain the starting block 10 temporarily affixed to the ground at a desired position and in a manner which is particularly adapted to resist forces applied longitudinally of the frame 11. A greater number of smaller or other arrangements of fastening devices known in the art could be employed.

In order to avoid sharp corners which could possibly injure a user of the starting block 10, the transition between the medial portion 12 and the attachment elements 20 may be a curved surface 23. Similarly the longitudinally outward extremities of the attachment elements 20 may have rounded corners 24 to minimize the risk of injury to a runner.

Positioned laterally of the frame 11 is a rear pad, generally indicated by the numeral 30, which is displaced longitudinally of the frame 11 a substantial distance from the starting line L. As shown, the rear pad 30 is for accommodating the right foot of a runner positioned on the starting block 10 with the right foot displaced rearwardly of the left foot as a matter of starting preference. The rear pad 30 may be a generally hollow triangular member having an upstanding supporting surface 31. The rear pad 30 has triangular webs 32 which support and rigidify the supporting surface 31 at each lateral extremity thereof. Constructed as a portion of the supporting surface 31 or as an extension thereto, an extension surface 31' is provided so that the surfaces 31, 13' provide an area of a size to accommodate the length and width of a runner's foot. As shown, the surfaces 31, 31' are positioned at an angle of approximately 45° to the ground or track upon which the starting block 10 is positioned. It is to be appreciated, however, that deviations on the order of 10° or 15° or more in either direction may produce equivalent results or may even be preferred by particular runners. In this respect it is to be understood that the surfaces 31, 31' provide the primary element at the instant of start against which the rear foot is thrust so that the opposed reaction of the rigid rear pad 30 propels or accelerates the runner outwardly from the starting block 10 across the starting line L.

Preferably a substantial portion of the surfaces 31, 31' may be covered with a hard elastomeric cover 33 which provides good traction for the outer sole or the spikes of a track shoe. Due to the extreme forces which may be developed in thrusting against the surfaces 31, 31', a pad 34 of resilient material may be applied over all or, as shown, an upper, rear portion of the cover 33. Such a pad 34 may be significant in reducing the possibility of heel bruises or other injury, particularly in the conduct of repeated starts. If an extended surface 31' is employed as depicted in FIGS. 1 and 2 of the drawings, a vertical support plate 35 may be employed for purposes of rigidifying the upper rearward extremity of the surface 31'.

The rear pad 30 is rigidly positioned in relation to the frame 11 as by a clamping bar, generally indicated by the numeral 40. As shown, the clamping bar 40 is a laterally projecting L-shaped member which is rigidly attached to the interior triangular side web 32. The clamping bar 40 has a laterally projecting leg 41 which overlies the upper surface 13 of the frame 11. The extremity of leg 41 has a downwardly projecting leg 42 which overfits flange 14 of the frame 11 to maintain the rear pad 30 in close proximity to and in projecting perpendicular alignment to the frame 11.

The rear pad 30 is maintained at a selected location longitudinally of the frame 11 by a locking assembly, generally indicated by the numeral 45, as best seen in FIGS. 1 and 3. The locking assembly 45 has a locking rod 46 which extends through alignment holes 47 in laterally opposed positions on the webs 32. The rod 46 is of sufficient length to extend into one of the bores 16 of the receiver 15 of the frame 11. As will be apparent to persons skilled in the art, any one of the bores 16 depicted in FIG. 2 may be employed to achieve the desired position of rear block 30 relative to the frame 11. The locking pin or rod 46 resides in the solid line position depicted in FIGS. 1 and 3 when extended into a bore 16. The locking rod 46 may be retracted from a selected bore 16 for repositioning block 30 longitudinally of the frame 11 by pulling it outwardly against the compression of a spring 48. In this retracted position the rod 46 no longer extends through a bore 16.

The rod 46 may be provided with a latch pin 49 which resides outside the outer web 32 when the pin is in the withdrawn position. The outer web 32 is provided with a slot 50 through which the latch pin 49 passes in moving the locking rod 46 between the retracted and extended positions. The locking rod 46 may be provided with a curved handle 51 at its outward extremity for purposes of facilitating movement between the extended and retracted positions and effecting rotation for the purpose of bringing the latch pin 49 into and out of coincidence with the slot 50.

Positioned laterally of the frame 11 closer to the starting line L than rear pad 30 and to the other side of the frame 11, is a front pad, generally indicated by the numeral 55. As seen in the drawings the front pad 55 differs substantially from the rear pad 30 in being a generally rectangular block having a substantially horizontal upper surface 56 which is substantially parallel to the track. The front pad 55 may be a substantially rectangular block 57 which may be of an elastomeric material such as a hard rubber. The block 57 is engaged and firmly positioned on the surface of the track by a pair of L-shaped holders 58 which engage the sides and preferably a portion of the lower surface of the block 57. The upper surface 56 of the block 57 may advantageously have spaced transverse grooves 59 for purposes of providing an irregular surface to improve gripping by a runner's foot. The front portion 56' of block 57 may taper downward slightly, as shown, for purposes of increasing traction with a runner's foot.

The forward edge of the block 57 has a slanted face 60 adapted to engage a portion of the front half of a runner's foot. As shown, the slanted face 60 may be at an angle of approximately 30° with respect to the track; however, other shallow angles or a slowly tapering curvilinear face to which a runner's foot comfortably conforms may be employed successfully. Being the secondary area to which pressure is applied subsequent to the moment of start, i.e., after pressure is applied by the rear foot to the rear pad 30, the forward portion of block 57 with slanted face 60 and surface 56' engage all of the foot, except for the first three or four inches which are extended along the slanted face 60 and onto the track surface. The forward portion of block 57 is thus configured in such a manner as to provide nonslipping stability and balance sufficient for a controlled secondary push to supplement the primary thrust developed from the rear foot engaging the rear pad 30.

The front pad 55 is detachably secured to the frame 11 as by an attachment assembly, generally indicated by the numeral 70. As shown, the attachment assembly 70 has an attachment rod 71 which extends through a bore 72 in the front pad 55. The attachment rod 71 is adapted to extend through bores 16 of the receivers 15 of the frame 11 and to receive a fastener 73 such as the conventional wing nut shown. It is to be appreciated that the attachment assembly 70 permits the assembly of the pad 55 to either side of the frame 11. As shown, the rectangular block 57 may be provided with a raised curved portion constituting a mounting collar 75 for the rod 71. The collar 75 is depicted substantially medially of the block 57 and thus located may be employed as a central arch supporting portion of the block 57, which may be employed by a runner to support the leading foot during preparatory stages of a start sequence. It is to be noted that the position of block 57, collar 75 and the holes 16 are such that when rod 71 is attached through the hole 16 of frame 11, the lower surface of the L-shaped holders 58 are in engagement with the surface of the track so that the front pad and particularly the upper surface 56 provide a stable, firmly seated platform for a runner's leading foot.

Figure 4:
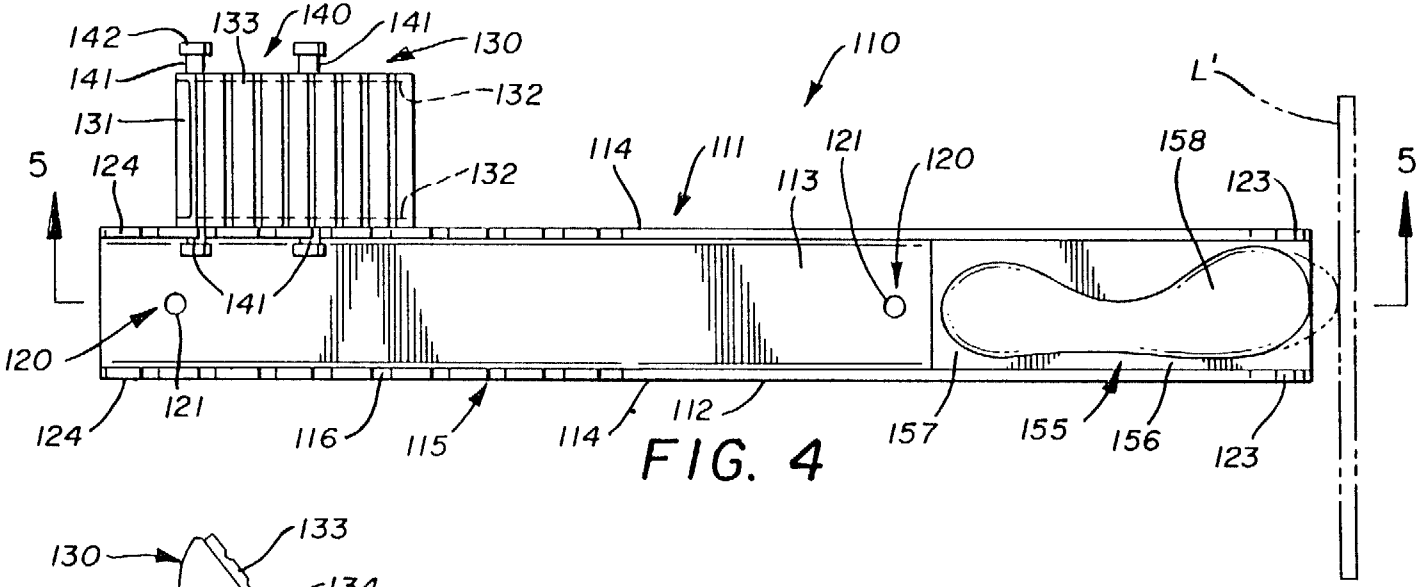
FIG. 4 is a top plan view of an exemplary starting block showing concepts of a second embodiment of the present invention positioned for utilization by a runner in a standing position proximate to the starting line of a running lane.
Figure 5:
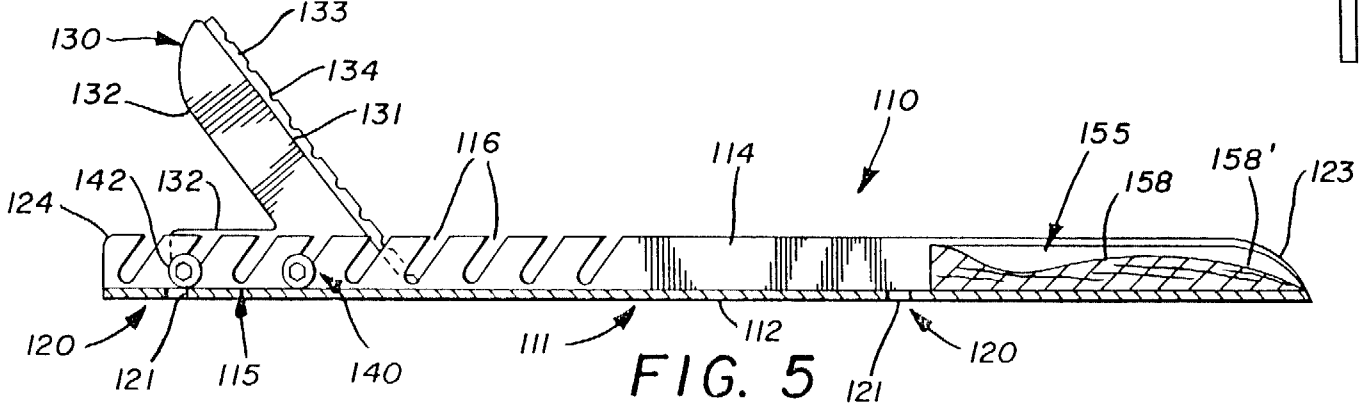
FIG. 5 is a cross-sectional view of the starting block of FIG. 4 depicting details of the foot pads and their attachment to the frame of the starting block.

A starting block for a runner according to the concepts of the second embodiment of the present invention is generally indicated by the numeral 110 in FIGS. 4 and 5 of the drawings. As shown for exemplary purposes, the starting block 110 may be positioned in close proximity to a starting line L' of a group of racing lanes. In this respect, it is to be appreciated that a conventional block for use by a runner employing the conventional crouched position would need to be positioned a substantial distance to the left as viewed in FIG. 4 in order to accommodate the horizontal extension of the trunk and rearwardly projecting leg of a runner to effect the necessary positioning of the runner's hands behind the starting line L'.

As shown, the starting block 110 has as the main longitudinal member aligned with the running lane and preferably positioned substantially perpendicular to the starting line L', a main frame or bar assembly, generally indicated by the numeral 111. Although the frame 111 may take various forms, as exemplified by prior art devices, the frame shown has a body portion 112 of generally rectangular configuration. As shown, the body portion 112 may be a generally U-shaped member having a uniform planar lower surface 113 with a projecting or upstanding flange 114 extending from either lateral extremity thereof (see FIG. 4). The body portion 112 is provided with structure for attachment of a foot supporting element, as described hereinafter, as by receivers, generally indicated by the numeral 115, which are positioned on the flanges 114 but could be otherwise positioned laterally of the lower surface 113. As shown, the receivers 115 constitute a plurality of spaced slots 116 positioned along a substantial extent of the rearward part of the length of the body portion 112 of frame 111 and extending from the upper edge of flanges 114 preferably downwardly and rearwardly to a position proximate the lower surface 113 for a purpose to be hereinafter described.

The body portion 112 of frame 111 has attachment elements, generally indicated by the numeral 120. As shown, each of the attachment elements 120 consists of a bore 121 for receiving fasteners such as the spikes 22 depicted in FIG. 2 which are adapted to extend a substantial distance below frame 111 for purposes of insertion into the ground or a track surface to maintain the starting block 110 temporarily affixed to the ground at a desired position and in a manner which is particularly adapted to resist forces applied longitudinally rearwardly of the frame 111. A greater number of smaller fasteners or other arrangements of fastening devices known in the art could be employed.

In order to avoid sharp corners which could possibly injure a user of the starting block 110, the longitudinal extremities of each of the flanges 114 of the body portion 112 may have curved surfaces 123 and 124 at the front and rear, respectively.

Positioned laterally of the frame 111 is a rear pad, generally indicated by the numeral 130, which is displaced longitudinally of the frame 111 a substantial distance from the starting line L'. As shown in FIGS. 4 and 5, the rear pad 130 is for accommodating the left foot of a runner positioned on the starting block 110 with the left foot displaced rearwardly of the right foot as a matter of starting preference. The rear pad 130 may be a generally open triangular member having an upstanding supporting surface 131. The rear pad 130 has triangular webs 132 which support and rigidify the supporting surface 131 at each lateral extremity thereof. The surface 131, provides an area of a size to accommodate the length and width of a runner's foot. As shown, the surface 131, is positioned at an angle of approximately 45° to the ground or track upon which the starting block 10 is positioned. It is to be appreciated, however, that deviations on the order of 10 or 15° or more in either direction may produce equivalent results or may even be preferred by particular runners. In this respect it is to be understood that the surface 131 provides the primary element at the instant of start against which the rear foot is thrust so that the opposed reaction of the rigid rear pad 130 propels or accelerates the runner outwardly from the starting block 110 across the starting line L'.

Preferably a substantial portion of the surface 131 may be covered with an elastomeric pad 133 which provides good traction for the outer sole or the spikes of a track shoe. The elastomeric pad 133 may advantageously have spaced lateral or transverse grooves 134 outwardly thereof for purposes of providing an irregular surface to improve gripping by a runner's foot.

The rear pad 130 is maintained at a selected location longitudinally of the frame 111 by a locking assembly, generally indicated by the numeral 140, as seen in FIGS. 4 and 5. The locking assembly 140 has a pair of projecting rods 141 on either lateral extremity which extend through the slots 116 in the flanges 114. For purposes of rigidity, the rods 141 may be of a diameter to snugly fit in the slots 116, and the rods 141 are spaced along the webs 132 a substantial distance. The slots 116 are advantageously equidistantly spaced longitudinally of the flanges 114 to receive the rods 141 at a number of positions therealong. For purposes of providing accurate positioning of the rear pad 130 along main frame 111, the slots 116 may be sufficiently closely spaced such that the rods 141 engage every second or more slots 116 when in operative position as depicted in drawing FIGS. 4 and 5. The rear pad 130 may be disassembled from the frame 111 for transport or movement to different slots 116 by applying a force to rear pad 130 substantially aligned with slots 116. With the slots 116 angled to the front of main frame 111 relative to a vertical orientation the rods 141 are more firmly seated in the slots 116 such as to preclude displacement therefrom upon the application of thrust directed rearwardly of frame 111 by a runner's foot engaging surface 131 during starting.

The rods 141 of rear pad 130 have at their laterally outward extremities knobs 142 which may be cylindrical and have a diameter at least slightly greater than the diameter of the rods 141 and thus the width of the slots 116. The knobs 142 are preferably displaced by the rods 141 a distance from the webs 132 which is slightly greater than the thickness of the flanges 114 of frame 111. In this manner the rear pad 130 when assembled on the frame 111 has the webs 132 abutting the flanges 114 in close proximity to assure that the rear pad 130 projects perpendicularly and forms a substantially rigid interrelationship.

Since each of the flanges 114 of body portion 112 have receivers 115 in the form of the slots 116 and since the rear pad 130 has a pair of rods 141 on each lateral extremity, it will be readily appreciated that the rear pad 130 may be positioned laterally to the other side of the main frame 111 from that depicted in FIG. 4 of the drawings. The rear pad 130 could thus be selectively located and locked in position to the lower side of frame 111 from that depicted in FIG. 4. This selectivity and positioning of the rear pad 130 relative to the frame 111 is advantageous for providing flexibility in use of starting block 110 by a plurality of different runners.

Positioned closer to the starting line L' than rear pad 130 and mounted on and preferably in lateral alignment with the frame 111 is pad, generally indicated by the numeral 155. As shown in FIGS. 4 and 5, lateral alignment of the front pad 15 and the frame 111 consists of the longitudinal axes of the front pad 155 and the frame 111 being substantially in the same vertical plane. As further seen in FIGS. 4 and 5 of the drawings, the front pad 155 differs substantially from the rear pad 130 in being a generally rectangular block 156 which may be of an elastomeric material such as hard rubber and have an upper surface 157 which is substantially horizontal or parallel to the track. The upper surface 157 may have a longitudinal indentation 158 which generally conforms to the configuration of all but the first few inches of a human foot. The front portion 158' of indentation 158 (see FIG. 5) may taper forwardly downwardly for purposes of increasing traction with a runner's foot and for purposes of readily permitting the toes and a portion of the ball of a runner's foot to extend beyond the block 156 and the frame 111 onto the surface of the running track in proximity to but spaced from the starting line L'. It will be appreciated that the starting block 110 is positioned on the track relative to the starting line L' at a selected position to achieve this relationship. The use of an indentation 158 generally conforming to the configuration of the sole of the human foot may be a preferred arrangement for effecting a combination of comfort, non-slipping stability and balance for a controlled secondary push to supplement the primary thrust developed from the rear foot engaging the rear pad 130 in the aforedescribed standing start.

The rectangular block 156 may be of a width slightly greater than the distance between the flanges 114 of frame 111. In this manner the front pad 155 in being constructed of a hard rubber may be positioned between the flanges 114 as seen in FIG. 4 by a lateral compression of block 156 which may be sufficient to maintain it in a desired position longitudinally of frame 111 during a runner's start. In this respect it is to be appreciated that it is the rear pad 130 which is subjected to the very significant thrust loading at the instant of starting. It will also be appreciated that a suitable adhesive may be employed between the block 156 and the flanges 114 and/or the lower surface 113 of body portion 112 to effect a bonding of the block 156 in position either independently of or as an adjunct to the compression of the elastomeric material of the block 156 as described above.

As shown, the indentation 158 in upper surface 157 of front pad 155 is particularly contoured for the right foot of a runner with the rear pad 130 being positioned to engage the left foot of a runner in the orientation depicted with respect to the starting line L'. It should also be appreciated that the indentation 158 might contain the approximate vertical variations of the arch and related portions of the human foot without having the lateral characteristics of either a right or left foot such that a front pad 155 so configured could be employed with either the left foot or right foot of a runner engaging the front pad 155. It should also be appreciated that the front pad 155 in lieu of being a human foot indentation 158 could be in accordance with the front pad 55 of the first embodiment of the invention. In this respect front pad 55 could be positioned between the upstanding flanges 114 and locked in place in the manner of the pad 55, i.e., with an attachment rod 71 extending through bores which could be appropriately located in the flanges 114 of frame 111.

Figure 6:
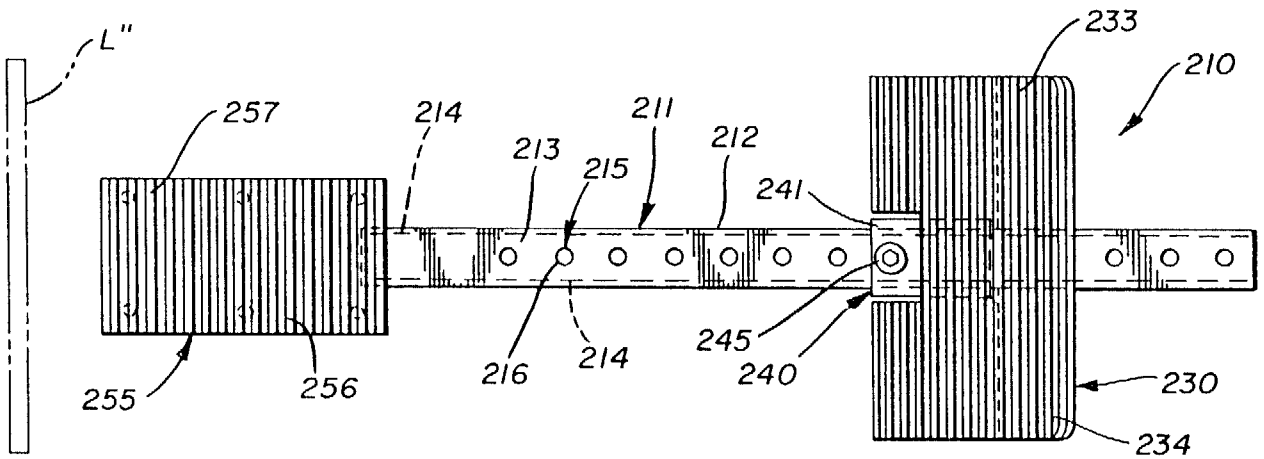
FIG. 6 is a top plan view of an exemplary starting block showing concepts of a third embodiment of the present invention positioned for utilization by a runner in a standing position proximate to the starting line of a running lane.
Figure 7:
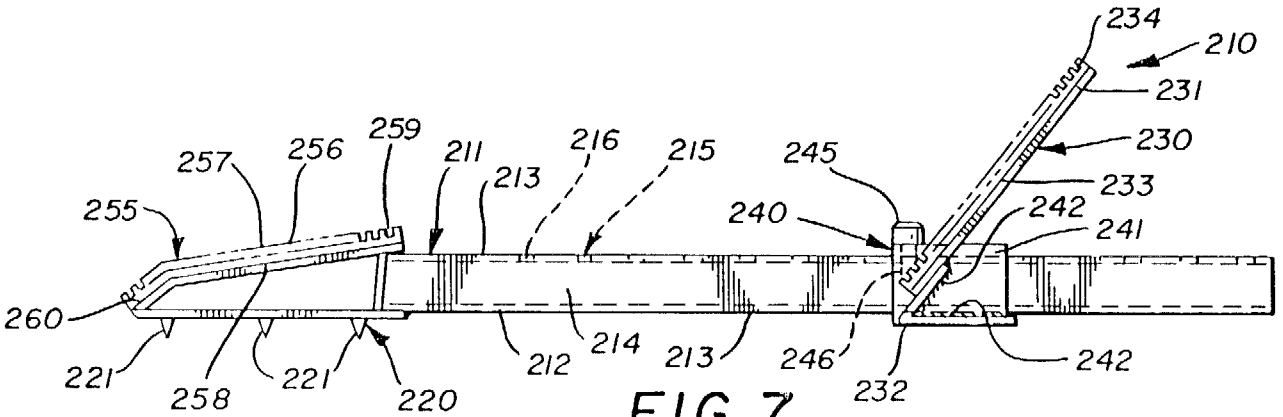
FIG. 7 is a side elevational view of the starting block of FIG. 6 depicting details of the foot supporting pads and their attachment to the central frame of the starting block.

A starting block for a runner according to the concepts of the third embodiment of the present invention is generally indicated by the numeral 210 in FIGS. 6 and 7 of the drawings. As shown for exemplary purposes, the starting block 210 may be positioned in close proximity to a starting line L" of a group of racing lanes. In this respect, it is to be appreciated that a conventional block for use by a runner employing the conventional crouched position would need to be positioned a substantial distance to the right as viewed in FIG. 6 in order to accommodate the horizontal extension of the trunk and rearwardly projecting leg of a runner to effect the necessary positioning of the runner's hands behind the starting line L".

As shown, the starting block 210 has as the main longitudinal member aligned with the running lane and preferably positioned substantially perpendicular to the starting line L" , a main frame or bar assembly, generally indicated by the numeral 211. Although the frame 211 may take various forms, the frame shown has a body portion 212 of generally rectangular configuration. As shown, the body portion 212 may be a tubular member having planar parallel upper and lower surfaces 213 with two parallel side surfaces 214 spacing and joining the upper and lower surfaces 213. The body portion 212 is provided with structure for attachment of a foot supporting element, as described hereinafter, as by receivers, generally indicated by the numeral 215, which are positioned on the upper surface 213. As shown, the receivers 215 constitute a plurality of bores 216 positioned at spaced intervals along a substantial extent of the rearward part of the length of the body portion 212 of frame 211 for a purpose to be hereinafter described.

Positioned laterally of the frame 211 is a rear pad, generally indicated by the numeral 230, which is displaced longitudinally of the frame 211 a substantial distance from the starting line L" . As shown in FIGS. 6 and 7, the rear pad 230 is for accommodating either foot of a runner positioned on the starting block 210 as a matter of starting preference. The rear pad 230 may be a generally open angular member having an upstanding supporting surface 231. As shown, the supporting surface 231 may be a planar member rigidly affixed to an angle iron 232 (FIG. 7). The surface 231, provides an area of a size to accommodate the length and width of a runner's foot to either side of frame 211. As shown, the surface 231, is positioned at an angle of approximately 45° to the ground or track upon which the starting block 210 is positioned. It is to be appreciated, however, that deviations on the order of 10° or 15° or more in either direction may produce equivalent results or may even be preferred by particular runners. In this respect it is to be understood that the surface 231 provides the primary element at the instant of start against which the rear foot is thrust so that the opposed reaction of the rigid rear pad 230 propels or accelerates the runner outwardly from the starting block 210 across the starting line L".

Preferably a substantial portion of the surface 231 may be covered with an elastomeric pad 233 which provides good traction for the outer sole or the spikes of a track shoe. The elastomeric pad 233 may advantageously have spaced lateral or transverse grooves 234 outwardly thereof for purposes of providing an irregular surface to improve gripping by a runner's foot.

The rear pad 230 is maintained at a selected location longitudinally of the frame 211 by a locking assembly, generally indicated by the numeral 240, as seen in FIGS. 6 and 7. The locking assembly 240 has a rectangular tubular sleeve 241 which is rigidly attached to the angle iron 232 as by welds 242, or to the surface 231, or both. The sleeve 241 is sized to fit over body portion 212 and preferably has interior cross-sectional dimensions only slightly greater than the external cross-sectional dimensions of the body portions 212 so that sleeve 241 will readily slide along body portion 212 but engage it sufficiently snugly such as to maintain surface 231 in perpendicular alignment with main frame 211 even when subjected to the thrust of a runner's foot upon starting. The locking assembly 240 also includes a pin 245 which extends through an aperture 246 in the sleeve 241 and is of sufficient length to extend into a bore 216 of the receivers 215. Thus, by sliding sleeve 241 along body portion 212 the aperture 246 may be brought into alignment with any selected bore 216 to temporarily affix rear pad 230 at any desired location along main frame 211 and locked in place by the pin 245. It will be appreciated that with pin 245 removed the sleeve 241 may be slidably positioned at any desired location along body portion 212 and may be removed therefrom as for packing and transporting or for replacement of all or part of the rear pad 230.

Positioned closer to the starting line L" than rear pad 230 and mounted on and preferably in lateral alignment with the frame 211 is a front pad, generally indicated by the numeral 255. As shown in FIGS. 6 and 7, lateral alignment of the front pad 255 and the frame 211 consists of the longitudinal axes of the front pad 255 and the frame 211 being substantially in the same vertical plane. As further seen in FIGS. 6 and 7 of the drawings, the front pad 255 differs substantially from the rear pad 230 in having a generally rectangular block 256 which may be of an elastomeric material such as hard rubber and have an upper surface 257 which is substantially horizontal or parallel to the track. The block 256 may be positioned on and supported by a polygonal frame 258 (FIG. 7) which is rigidly attached to the body portion 212 of the main frame 211 and lies on the track surface. The upper surface 256 of the block 257 may advantageously have spaced transverse grooves 259 for purposes of providing an irregular surface to improve gripping by a runner's foot.

The forward edge of the block 257 has a slanted face 260 adapted to engage a portion of the front half of a runner's foot. As shown, the slanted face 260 may be at an angle of approximately 30° with respect to the track; however, other shallow angles or a slowly tapering curvilinear face to which a runner's foot comfortably conforms may be employed successfully. Being the secondary area to which pressure is applied subsequent to the moment of start, i.e., after pressure is applied by the rear foot to the rear pad 230, the forward portion of block 257 and slanted face 260 engage all of the foot, except for the first three or four inches which are extended along the slanted face 260 and onto the track surface. The forward portion of block 257 is thus configured in such a manner as to provide nonslipping stability and balance sufficient for a controlled secondary push to supplement the primary thrust developed from the rear foot engaging the rear pad 230.

The polygonal frame 258 of front pad 255 has track gripping or attachment elements, generally indicated by the numeral 220. As shown, the gripping elements 220 consist of a plurality of spikes 221 which are adapted to extend a distance below frame 211 for purposes of insertion into the ground or a track surface to maintain the starting block 210 temporarily affixed to the ground at a desired position and in a manner which is particularly adapted to resist forces applied longitudinally rearwardly of the frame 211. A greater number of smaller fasteners or other arrangements of fastening devices known in the art could be employed, as could the use of gripping elements 220 on a portion of the main frame 211 or on the underside of angle iron 232 or sleeve 241 of rear pad 230.

The starting blocks 10, 110, 210 can readily be constructed of various metals, appropriately selected plastics or combinations of materials as will be appreciated by persons skilled in the art, with the exception of the preferred use of elastomeric or resilient members herein specifically suggested. It is also to be appreciated that various devices for attaching pads to a central frame or bar could be adapted from devices known to persons skilled in the art. As will also be apparent to persons skilled in the art modifications can be made to the preferred embodiments disclosed herein, such as particular dimensions, or spacing of the pads, without departing from the spirit of the invention, the scope of the invention being limited solely by the scope of the attached claims. It should also be evident that the starting blocks disclosed herein carry out the various objects of the invention set forth hereinabove and otherwise constitute an advantageous contribution to the art.

I claim:

1. Starting block apparatus for a runner to be used on a track having running lanes extending from a starting line to a finish line comprising, frame means for positioning in alignment with a running lane proximate to the starting line, means for maintaining said frame means at a selected location on the track, first pad means attached longitudinally of said frame means and having a substantially horizontal surface for supporting the front foot of a runner in a standing position, and second pad means selectively attachable longitudinally of said frame means and having an angularly upwardly extending surface for engagement by the rear foot of a runner in a standing position to assist in thrusting the runner across the starting line in a running lane toward the finish line, said first pad means being mounted on and in lateral alignment with said frame means and said second pad means extending laterally to one side of said frame means.

2. Apparatus according to claim 1, wherein said first pad means and said frame means are an integral unit and said second pad means is a separate unit.

3. Apparatus according to claim 1, wherein said first pad means has an indentation which substantially conforms with a portion of the foot of a runner.

4. Apparatus according to claim 1, wherein the front portion of said first pad means tapers forwardly downwardly.

5. Apparatus according to claim 1, wherein said frame means has a generally U-shaped body portion.

6. Apparatus according to claim 5, wherein said first pad means has a substantially rectangular configuration and said body portion has a lower surface and upstanding flanges at the lateral extremities for receiving said first pad means.

7. Apparatus according to claim 6, wherein said first pad means is adhesively bonded to said body portion of said frame means.

8. Apparatus according to claim 1, wherein said second pad means is laterally offset relative to said frame means.

9. Apparatus according to claim 1, wherein said angularly upwardly extending surface of said second pad means is at an angle of approximately 45° to the track.

10. Apparatus according to claim 1, wherein said frame means has upstanding flanges having receiver means for selectively positioning said second pad means therealong.

11. Apparatus according to claim 10, wherein said second pad means has locking means for engaging said receiver means of said frame means.

12. Apparatus according to claim 11, wherein said receiver means includes a plurality of spaced slots and said locking means includes a pair of projecting rods extending from a lateral extremity of said second pad means for engaging said slots.

13. Apparatus according to claim 12, wherein a pair of upstanding flanges each have a plurality of slots and a pair of projecting rods extending from each lateral extremity of said second pad means whereby said second pad means may be selectively locked in position laterally to either side of said frame means.

14. Apparatus according to claim 13, wherein said slots extend downwardly and rearwardly of said upstanding flanges.

15. Apparatus according to claim 13, wherein said projecting rods mount knobs having dimensions slightly greater than the diameter of said projecting rods, said knobs being displaced by said rods from webs on said second pad means a distance which is slightly greater than the thickness of said upstanding flanges.

16. Apparatus according to claim 1, wherein said first pad means is permanently attached to said frame means at the front extremity thereof.

17. Apparatus according to claim 1, wherein said second pad means extends laterally to both sides of said frame means to accommodate a runner's foot to either side of said frame means.

18. Apparatus according to claim 17, wherein said second pad means includes sleeve means which encompasses and is slidably mounted on said frame means for selective positioning longitudinally thereof.

19. Apparatus according to claim 17, wherein said first pad means is rigidly mounted at the extremity of said frame means, and is of a greater lateral width than said frame means but of a substantially lesser lateral width than said second pad means.

20. Apparatus according to claim 17, wherein said first pad means has a slanted face at the forward edge thereof for engagement by the front portion of the front foot of a runner.

* * * * *

UNITED STATES PATENT AND TRADEMARK OFFICE

CERTIFICATE OF CORRECTION

PATENT NO. : 4,913,420

DATED : April 3, 1990

INVENTOR(S) : Charles W. Moye

It is certified that error appears in the above-identified patent and that said Letters Patent is hereby corrected as shown below:

Col. 1, Line 5, "06/856" should read --06/856,589--

Col. 1, Lines 5 and 6, "now U.S. Pat. No. 4754965 filed Apr. 25, 1986," should read --filed Apr. 25, 1986, now U.S. Pat. No. 4,754,965,--

Col. 10, Line 12, "is pad," should read --is a front pad,--

Col. 10, Line 14, "front pad 15" should read --front pad 155--

Signed and Sealed this

Twenty-third Day of July, 1991

*Attest:*

HARRY F. MANBECK, JR.

*Attesting Officer*

*Commissioner of Patents and Trademarks*